United States Patent [19]

Seibt et al.

[11] Patent Number: 4,922,880

[45] Date of Patent: May 8, 1990

[54] FUEL INJECTOR FOR INTERNAL COMBUSTION ENGINES

[75] Inventors: Artur Seibt, Vienna; Heinrich Maly, Kottingbrunn; Harald Fleck, Schwechat; Gottfried Haider, Linz, all of Austria

[73] Assignee: Voest-Alpine Automotive Gesellschaft MB. II., Linz, Austria

[21] Appl. No.: 256,797

[22] Filed: Oct. 12, 1988

[30] Foreign Application Priority Data

Oct. 26, 1987 [DE] Fed. Rep. of Germany ..... 3736198

[51] Int. Cl.[5] ..... F02M 39/00; B05B 1/30

[52] U.S. Cl. ..... 123/509; 123/470; 123/497; 239/585

[58] Field of Search ..... 123/509, 497, 498, 499, 123/198 C, 198 E, 470, 471; 239/585, 88, 95; 73/119 A

[56] References Cited

U.S. PATENT DOCUMENTS

| | | | |
|---|---|---|---|
| 2,598,528 | 5/1952 | French | 123/499 |
| 4,227,695 | 5/1982 | Schechter | 123/499 |
| 4,312,316 | 11/1982 | Seilly | 123/497 |
| 4,339,082 | 7/1982 | Radaelli | 239/585 |
| 4,345,565 | 8/1982 | Bottoms | 123/492 |
| 4,373,671 | 2/1983 | Giardini | 239/585 |
| 4,430,983 | 2/1984 | Hagen | 239/585 |
| 4,700,891 | 10/1987 | Hans | 239/585 |
| 4,718,386 | 1/1988 | Gieles | 123/499 |
| 4,811,715 | 3/1989 | Djordjevic | 123/506 |
| 4,834,295 | 5/1989 | Gristiani | 239/585 |

FOREIGN PATENT DOCUMENTS

| | | | |
|---|---|---|---|
| 3439672 | 4/1986 | Fed. Rep. of Germany | 239/585 |
| 3705771 | 9/1988 | Fed. Rep. of Germany | 123/497 |

*Primary Examiner*—Carl S. Miller

*Attorney, Agent, or Firm*—Armstrong, Nikaido, Marmelstein, Kubovcik & Murray

[57] ABSTRACT

A fuel injector for an internal combustion engine which includes a housing having a flange for mounting the fuel injector to a cylinder head, a pump jet and at least one electrical component internal of the housing, a pair of electrical connector leads for the electrical component, an aperture extending through the flange, and a portion of the electrical connector leads extending from internally of the housing and terminating in the aperture, thereby permitting the pair of electrical connector leads to be connected with another pair of electrical connector leads in the aperture. The ends of the electrical connector leads are preferably provided with electrical connecting elements secured in the aperture and the other pair of electrical connector leads may be provided in the form of an extension or plug adapted to engage the electrical connecting elements in the aperture.

13 Claims, 3 Drawing Sheets

FUEL INJECTOR FOR INTERNAL COMBUSTION ENGINES

BACKGROUND OF THE INVENTION

The invention relates to a fuel injector for internal combustion engines, or particularly a pump jet having a housing in which an electrical sensor such as an electrical injector needle lift sensor for the injector needle and/or an actuator such as an electromagnetic volume regulator are disposed with electrical connection leads that are brought out of the housing for connection with other leads forming a part of a power supply or control circuit.

In fuel injectors that can be screwed into a cylinder head it has become known through West German Pat. No. A 30 04 424 or European Pat. No. 68 339 to bring the leads of the induction coil of an injector needle lift sensor upwardly through the housing of the injector for engagement with a plug connector. After the injector has been screwed in, a cable with appropriate mating connectors can be plugged into the connectors of the injector. It is considered a disadvantage that such a plug connection is essentially unprotected in the space between the cylinder head and valve cover which is filled with oil and vapors, because the possibility exits, on the one hand, that the contacts may corrode and, on the other hand, there is the considerable danger that, due to engine vibrations, the plug connections may become undone. It is also undesirable, from the point of view of easy maintenance, that, in a 6-cylinder engine, twelve individual connectors must be plugged in. Sealing the penetration of all cables through the valve cover in a fluid-tight manner may also present problems.

In so-called pump jets in which, for example, a high-pressure pump actuated by a cam and a fuel injector are combined into a single unit, the quantity of fuel to be injected can be adjusted with a volume regulator. Here, electromagnetic volume regulators on each pump jet have become known which are controlled by a central processor to permit individual fuel metering for each cylinder.

Pump jets with a flange for clamping the pump jet down on the cylinder head are disclosed, for example, in Austrian Pat. No. 353 558 and Austrian Pat. No. 372 502. However, these jets are neither equipped with an injector needle lift sensor nor with an electromechanical volume regulator.

The object of the invention is the provision of a fuel injector of the kind mentioned in the introduction, in which a simple easy-to-maintain, yet reliable, arrangement for contacting and making electrical connection with the connection leads is possible despite the difficult ambient conditions.

This object can be achieved with the fuel injector disclosed herein which provides, a reliable electrical connection of the jet unit that can be quickly or automatically established with cables leading to a central processor or the like.

Further advantages of the invention and modifications will be apparent from the ensuing description of specific embodiments and the claims appended hereto.

DETAILED DESCRIPTION OF THE PREFERRED EMBODIMENTS

Figure 1:
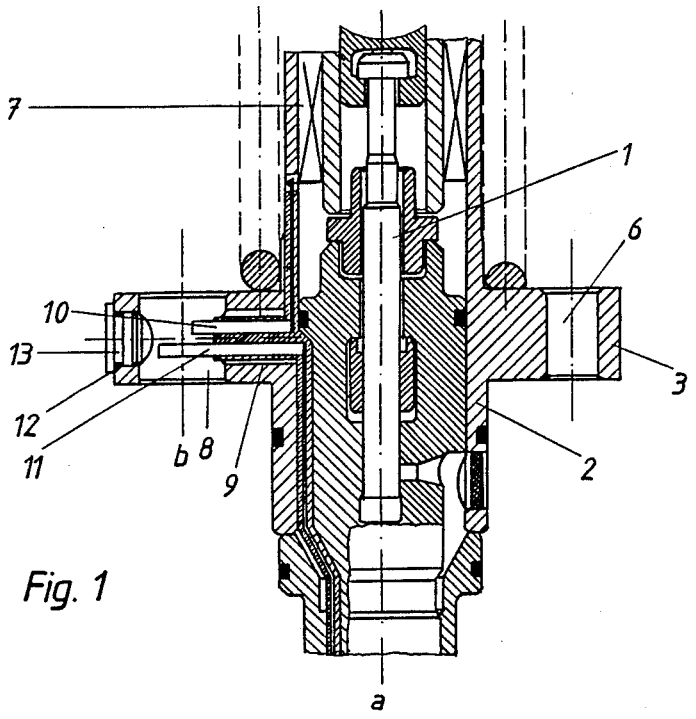
FIG. 1 is a vertical section through a pump jet taken along the line I—I of FIG. 2, with the upper and lower parts of the jet omitted.
Figure 2:
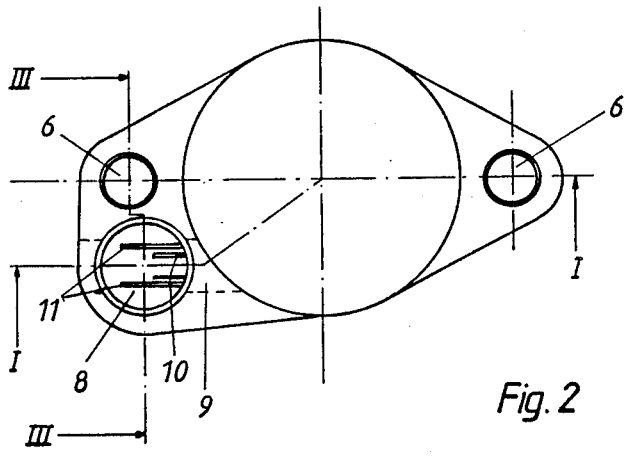
FIG. 2 is a top plan view of the pump jet shown in FIG. 1.
Figure 4:
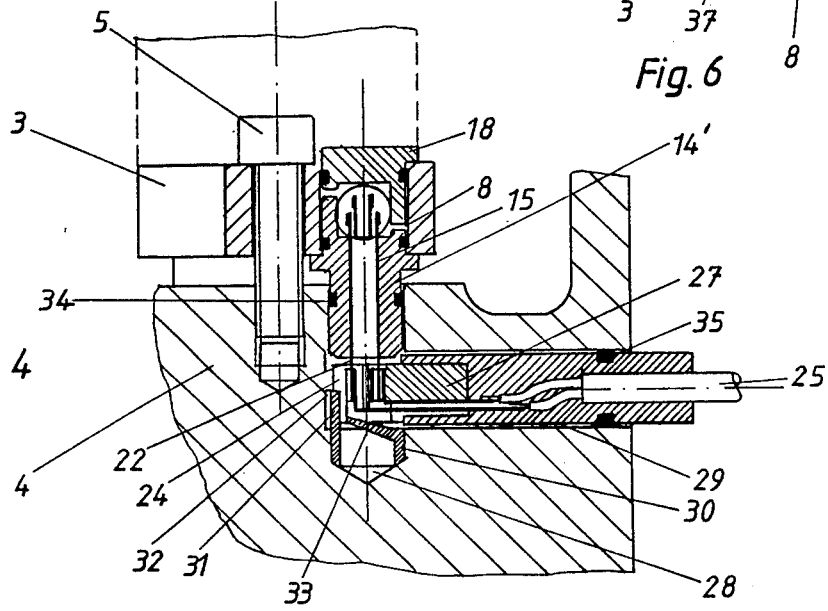
FIG. 4 is a sectional view similar to FIG. 3 but showing another embodiment with a downwardly projecting connector extension and a connector in the cylinder head.

FIG. 1 shows a portion of a pump jet which is used to inject fuel into the cylinders of Diesel engines. The upper and lower parts of the jet, the details of which are not pertinent to the present invention, are not shown. Such pump jets are arranged on the cylinder head of an engine. The pump plunger 1 of the jet is actuated in a manner not shown by a tappet or the like by a camshaft, rocker arms, etc. In the lower part (not shown) of the pump jet there is provided a spring-loaded valve needle which opens a nozzle opening when the pump plunger 1 has built up a specific pressure. The lower part of the pump jet is inserted into a bore in the cylinder head while inserting an appropriate seal, with the nozzle opening being located in the combustion chamber of a particular cylinder. The housing 2 of the pump jet has a flange 3 with which it can be clamped down on the cylinder head 4 with machine screws or bolts 5 as shown by FIG. 4. Two bores 6 are provided in the flange 3 on opposite sides of the jet axis 1 for the machine screws. It should be noted, however, that the flange 3 need not necessarily have bores for receiving screws, since the flange can also be clamped down indirectly with clamp claws or the like.

In the embodiment shown, the fuel delivery regulator is adjusted electromechanically. To this end, an actuator coil 7 is provided which, both with respect to its shape and its location, is shown only schematically. Furthermore, in the model shown, an electrical injector needle lift sensor is also normally provided in the lower part of the pump jet but is not shown since it does not constitute a pertinent part of the invention.

As a rule, two electrical connection leads are needed for the power supply to the volume regulator and two connection leads for the injector needle lift sensor. As mentioned in the introduction, the present invention relates to the connection of these connection leads to wires or cables that lead to an electronic control device.

In one part of the flange 3 there is formed a circular aperture or through-hole 8 parallel to the jet axis 'a'. An outlet bore 9 extends from the interior of the housing 2 to the aperture 8. There extends in the housing 2 the connection lead 10 or 11 for the volume regulator or the injector needle lift sensor. These leads 10 and 11 are for example formed as flexural blanks coated with plastic material and are guided through the outlet bore 9 into the through-hole 8 where their terminal ends are accessible for connection with other components. The ends of the leads 10 and 11 may be held secure by mechanical means and sealed off in the outlet bore 9. A bore part 12 radially opposing the outlet bore 9 with respect to the axis 'b' of the through-hole 8 can be sealed in a fluid-tight manner with a plastic stopper 13.

The ends of the connection leads 10 and 11 are provided in through-hole 8 with plug contacts or by inserting a plug component. This will be further explained in the following section with reference to three embodiments.

Figure 3:
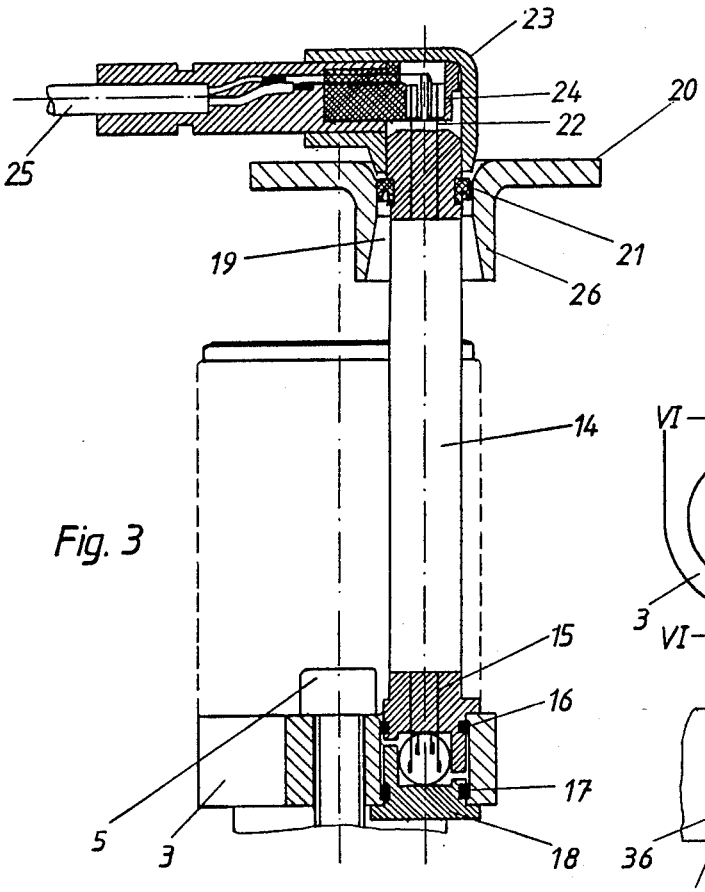
FIG. 3 is a sectional view taken along the line III—III of FIG. 2 showing one embodiment of the invention with an upwardly projecting connector extension.

The embodiment shown in FIG. 3 has an oblong, cylindrical plug component in the form of a connector extension 14 of plastic material, which is inserted from above into the through-hole 8. In the plug component 14 there are provided a second pair of electrical connector leads in the form of interconnectors 15, whose lower ends are electrically connected to the ends of the connection leads 10 and 11. This interconnection can be accomplished by soldering or welding or it can be implemented as a detachable or non-detachable plug connection. A ring seal 16 seals the base portion of the plug component 14 from the through-hole 8. The through-hole 8 is sealed on the underside of the flange 3 with a sealing member or shut-off stopper 18 that carries a ring seal 17.

The plug component 14 projects upward and its upper end is guided through an opening 19 in the valve cover 20, with a ring seal 21 ensuring the required sealing. From the head portion of the plug component 14 there project contact pins which are electrically connected to the interconnectors 15. There can be placed on the head of the plug component 14 a connecting plug 23, which has sleeves 24 assigned to receive the contact pins. A connecting cable 25 extends outwardly from the connecting plug.

The above-described embodiment has the advantage that no special precautions need be taken in the cylinder head of the engine. The injectors are clamped down with the flange 3 on the cylinder head and the valve cover 20 is then placed on the cylinder head with the head parts of the oblong plug components 14 being guided through the openings 19 in the valve cover 20. A ring collar 26, which flares conically downward and protrudes from the openings 19, facilitates this process. After putting on and tightly screwing the valve cover 20, the connection plugs 23 are placed on the plug components 14.

In a further embodiment shown in FIG. 4, a plug component in the form of a connector extension 14' is provided which, in principle, is similar to the plug component 14 shown in FIG. 3, but which is shorter and is so inserted into the through-hole 8 through the surface of the flange 3 which faces the cylinder head that it protrudes downwardly, that is, in the direction of the cylinder head 4. Therefore, in this case the shut-off stopper or sealing member 18 seals the through-hole 8 at its upper end. At its free end, the plug component 14' is again provided with contact pins.

In the embodiment illustrated in FIG. 4, a plug component 27, firmly seated in the cylinder had 4, is assigned to the contact pins. To this end, in the cylinder head 4 there is formed a blind bore or pocket hole 28 which, when the injector is inserted, is coaxial with the through-hole 8. There opens into the pocket hole 28 a transverse hole 29 which extends transversely relative to the hole 28. The plug 27 can be pushed in the transverse hole 29 from the outside. In the bottom area of the pocket hole 28 there is positioned a latch-and-centering member 30. This member 30 has a centering web 31 which, cooperating with a lug 32 of plug 27, ensures its proper angular position. A resilient locating web 33 holds plug 27 in its position in which the sleeves 24 are exactly aligned with contact pins of the plug component 14'. A ring seal 34 at the lower end of the plug component 14'and a ring seal 35 at the plug member 27 ensure that the vapors and atomized oil in the area above the cylinder head 4 cannot reach the contacts of the connector or emerge to the outside.

Although the embodiment shown in FIG. 4 requires an appropriately adapted cylinder head, the electrical connection occurs automatically when the injector is being inserted, so it is not necessary to remove or put on a plug and the allocation of the individual connecting cables 25 to the cylinders of the engine or of its injectors is unmistakably fixed.

Figure 5:
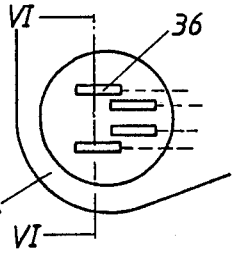
FIG. 5 is a top plan view of an insulating member securing receptacles in a flange of the jet housing.
Figure 6:
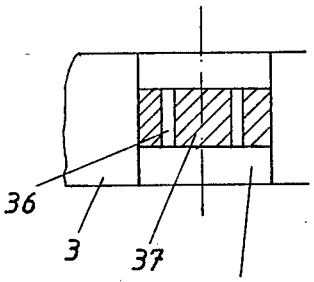
FIG. 6 is a sectional view taken along the line VI—VI of FIG. 5, and FIGS. 7 to 9 show three views, partly in section, of alternate arrangements for sealing and connecting the upper end of a connector extension extending through a valve cover.

Another embodiment of the invention is apparent from FIGS. 5 and 6. Here, the ends of the connecting leads 10 and 11 are provided in the through-hole 8 with electrical connecting elements in the form of contact sleeves 36, which extend in the axial direction and are fixed in an insulating member or tube 37. The insulating tube 37 is held firmly in the through-hole 8 with suitable devices. Advantageously, the contact sleeves 36 extend along the length of the insulating tube as shown by FIG. 6 and can be plugged from above as well as from below. It will be understood that, instead of the sleeves 36, upwardly and/or downwardly projecting pins may be provided, or that sleeves and pins may be combined. This is generally also applicable to the versions described above.

In the embodiment shown in FIGS. 5 and 6, a stationary mating plug component may be provided on the cylinder head. In this case, the plug-in connection, upon insertion of the injector, is established automatically from below, just as in FIG. 4. A plug-in connection can be established from above with a suitable plug, just as in FIG. 3. As shown in FIGS. 3 and 4, the unused side of the insulating tube 37 can be sealed off with a shut-off stopper 18 or the like. Furthermore, a combination of the versions in FIG. 3 or 4 with those of FIGS. 5 and 6 is possible, which means that the plug component 14 or 14' can be plugged on both sides thereof.

Figure 7:
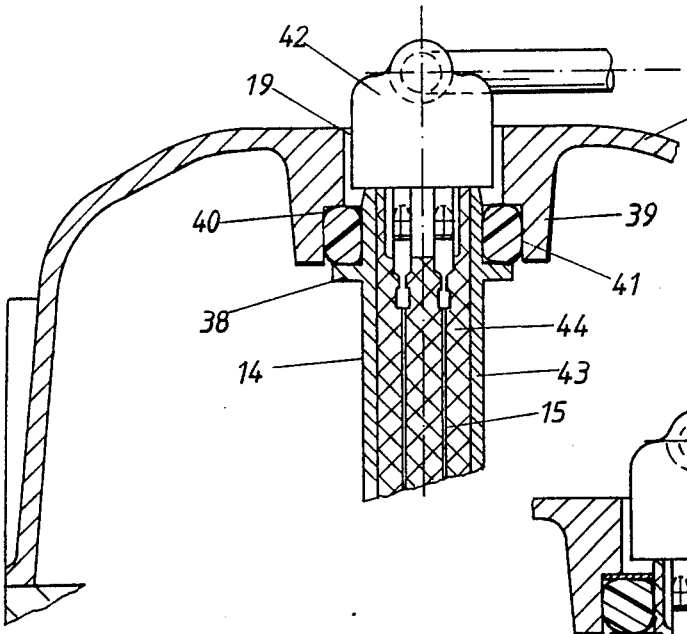
Figure 8:
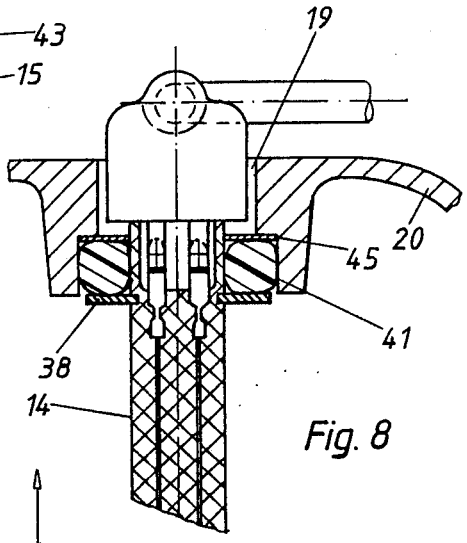
Figure 9:
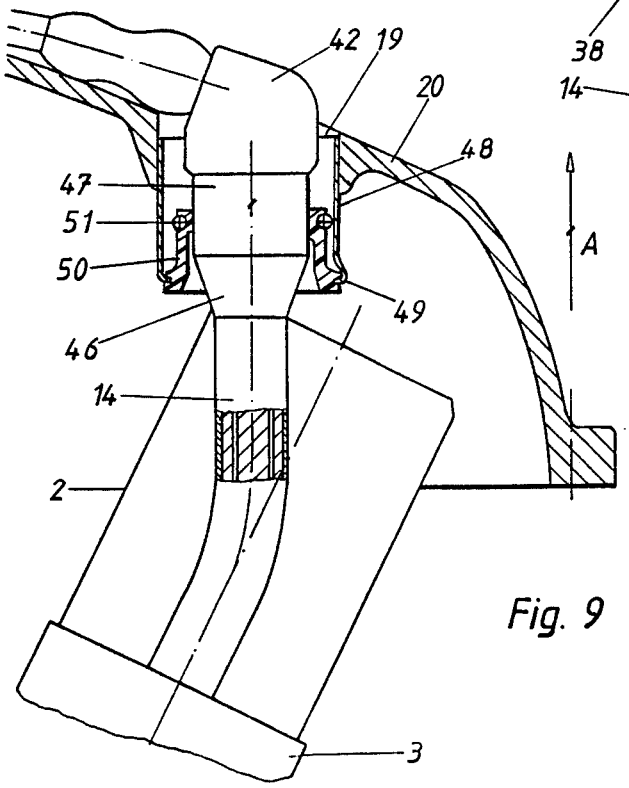

FIGS. 7 to 9 show different views of a plug component or connector extension 14 extending through the valve cover or "control housing cover" 20, that is, modifications of the upper portion of the component 14 shown at the top of FIG. 3.

In the version shown in FIG. 7, the plug component 14 has near its upper ends an annular flange 38, and on the inside of a ring collar 39 extending downward from the valve cover 20 there is formed a peripheral recess 40, which is open at the bottom. A soft ring seal 41 is embedded in the recess 40 and supported on the annular flange 38. This seal arrangement also effectively prevents the penetration of injection fuel through the opening 19 of the valve cover 20. The housing of the plug 42 penetrates deeply into the hole of the ring collar 39 and thereby protects the actual contacts against dirt as well. As apparent from the drawings, the annular flange 38 protrudes from a pipe 43, preferably a metal pipe, which protectively encloses an insulating interior part housing the interconnectors 15.

Another version shown in FIG. 8 differs from that of FIG. 7 in that the plug component 14 made of plastic material has no external protective pipe and the annular flange 38 is formed as a metal disk cast with, or pressed into, the plug component 14. Moreover, for better support of the seal 41, another metal disk 45 is embedded in the recess of the annular collar 39.

If the pump jet with its housing 2, together with the flange 3, is seated obliquely in the cylinder had, it is advisable to confer upon the plug component 14 a curvature such that its upper section with the contacts runs parallel to the lift-off direction A of the valve cover 20, as shown in FIG. 9. The mounting and dismounting of the cover 20 and the plug 42 is facilitated thereby and can proceed more rapidly.

In the version depicted in FIG. 9, the outer sleeve of the plug component 14 is a metal pipe which at the top, across a conical cross-over area 46, continues as an end piece 47 having a larger diameter. The contact sleeves and/or pins are seated in the end piece 47. There is fitted in the hole 19 in the valve cover 20, aligned with its lift-off direction A, a metal sleeve 48 which forms an annular collar. A flexible cylindrical sealing lip 50 made of hot oil-resistant elastomer extends upwardly in the interior of the sleeve 48 and is bonded by vulcanization to a lower edge 49 of this sleeve 48, which is bent back inwardly. The upper end region of this sealing lip 50 is pressed by a ring-shaped tension hose spring 51 against the end piece 47 of the plug component 14. Thus, an effective seal is obtained which also permits relatively high manufacturing tolerances.

While only one aperture or through-hole 8 is shown in the flange 3 in the drawings, it is also possible to provide, say, two such through-holes with appropriate electrical connection leads in each hole, if the need arises. The number of connection leads or contacts depends on the jet construction. In general, if the jet contains only one injector needle lift sensor, two connection leads are sufficient. This is also true if the jet contains only one adjusting magnet but no injector needle lift sensor. It is also possible, however, to include an electrical indicator unit with the volume regulator, so that in this case, if at the same time an injector needle lift sensor is also used, one needs at least six connection leads.

We claim:

1. A fuel injector for an internal combustion engine comprising:

a housing having a flange adapted for mounting said housing to a cylinder head of said engine, a pump jet internal of said housing, said pump jet having a longitudinal axis extending substantially normal to said flange, at least one electrical component internal of said housing, a first pair of electrical connector leads for said electrical component, at least one aperture extending through said flange, and a portion of said first pair of electrical connector leads extending from internally of said housing and terminating in said aperture, whereby said first pair of electrical connector leads may be connected with a second pair of electrical connector leads in said aperture.

2. The fuel injector defined by claim 1, further including a bore extending from the interior of said housing to said aperture and said portion of said first pair of connector leads extends through said bore.

3. The fuel injector defined by claim 2, wherein said aperture is a circular through-hole having an axis substantially parallel to the longitudinal axis of said pump jet.

4. The fuel injector defined by claim 2, wherein each of said first and second pairs of electrical connector leads are respectively provided with an electrical connecting element selected from the group consisting of a sleeve and a pin adapted to be slidably received in said sleeve, an insulating member is provided internally of said aperture and said electrical connecting elements provided to said first pair of electrical connector leads are secured in said insulating member.

5. The fuel injector defined by claim 4, wherein said electrical connecting elements secured in said insulating member are accessible from each side of said flange whereby the electrical connector elements provided to said second pair of electrical connector leads may be inserted in said aperture to effect electrical connection with the electrical connecting elements provided to said first pair of electrical connection leads from either side of said flange.

6. The fuel injector defined by claim 5, wherein said second pair of electrical connector leads are inserted in said aperture from one side of said flange and further including a sealing member inserted in said aperture from the other side of said flange to seal said aperture.

7. The fuel injector defined by any one of claims 1, 4, 5 or 6, wherein said second pair of electrical connector leads are provided as part of a connector extension, said second pair of electrical converter leads are provided with electrical connecting elements at each end of said extension, one end of said extension is inserted in said aperture from a side of said flange facing said cylinder head and the electrical connecting elements at the other end of said extension engage a plug provided in a recess of said cylinder head.

8. The fuel injector defined by claim 7 further including a bore in said cylinder head coaxial with said aperture and adapted to receive said other end of aid extension as said housing is mounted to said cylinder head.

9. The fuel injector defined by claim 8 further including a second bore in said cylinder head, said second bore extending transversely of and intersecting said bore coaxial with said aperture and receiving said plug engaged by said other end of said connector extension.

10. The fuel injector defined by claim 9, wherein a latch and centering member is provided in said bore coaxial with said aperture and includes means for centering and locking said plug in said second bore.

11. The fuel injector defined by any one of claims 1, 4, 5 or 6 wherein said second pair of electrical connectors are provided as part of a connector extension, said second pair of electrical connector leads are provided with electrical connecting elements at each end of said extension, one end of said extension is inserted in said aperture from a side of said flange facing a valve cover of said engine, an aperture through said valve cover, the other end of said extension passes through said aperture through said valve cover and means providing a fluid tight seal between said other end of said extension and said valve cover.

12. The fuel injector defined by claim 11 further including a depending collar surrounding said aperture through said valve cover.

13. The fuel injector defined by claim 11 further including a metal sleeve depending from said valve cover and surrounding the other end of said extension, a flexible, cylindrical elastomer seal vulcanized to the lower depending end of said metal sleeve and extending upwardly inside the metal sleeve and a tension spring pressing an upper portion of said seal against said other end of said extension.

* * * * *